United States Patent [19]

Jacobson

[11] Patent Number: 5,042,450

[45] Date of Patent: Aug. 27, 1991

[54] ARROW SUPPORT FOR AN ARCHERY BOW

[76] Inventor: William J. Jacobson, P.O. Box 3196, Centerline, Mich. 48015

[21] Appl. No.: 538,117

[22] Filed: Jun. 14, 1990

[51] Int. Cl.[5] ..... F41B 5/00

[52] U.S. Cl. ..... 124/44.5; 124/24.1

[58] Field of Search ..... 124/24.1, 44.5, 88, 124/20.3, 22, 26

[56] References Cited

U.S. PATENT DOCUMENTS

| | | | |
|---|---|---|---|
| 213,083 | 3/1879 | Wright et al. | 124/24.1 |
| 736,051 | 8/1903 | Adams | 124/24.1 |
| 1,847,593 | 3/1932 | Cameron | 124/24.1 |
| 2,808,043 | 10/1957 | Lombard | 124/24.1 X |
| 3,406,675 | 10/1968 | Fredrickson | 124/25.7 |
| 4,282,850 | 8/1981 | Warnicke | 124/44.5 X |
| 4,351,311 | 9/1982 | Phares | 124/44.5 |
| 4,372,282 | 2/1983 | Sanders | 124/24.1 |
| 4,421,092 | 12/1983 | Christian | 124/44.5 |
| 4,476,846 | 10/1984 | Carville | 124/44.5 |
| 4,587,945 | 5/1986 | Little | 124/88 X |
| 4,664,093 | 5/1987 | Nunemaker | 124/44.5 X |
| 4,703,745 | 11/1987 | Hammond | 124/44.5 |
| 4,759,337 | 7/1988 | Suski | 124/24.1 |
| 4,917,072 | 4/1990 | Chang | 124/24.1 X |

OTHER PUBLICATIONS

C & M Sports Brochure, Series 1000 Archery Sight.

*Primary Examiner*—Peter M. Cuomo
*Assistant Examiner*—Jeffrey L. Thompson
*Attorney, Agent, or Firm*—Krass & Young

[57] ABSTRACT

An apparatus for supporting an arrow on an archery bow. The apparatus having an adjustable resilient finger member which is circumferentially adjustable on an annular frame member. The finger member being tapered so that the resiliency decreases in magnitude from the mounting end to the supporting end. The finger compensates for variable degrees of arrow distortion resulting in a maximum transfer of the energy from the bow string to the arrow.

12 Claims, 3 Drawing Sheets

FIG - 1
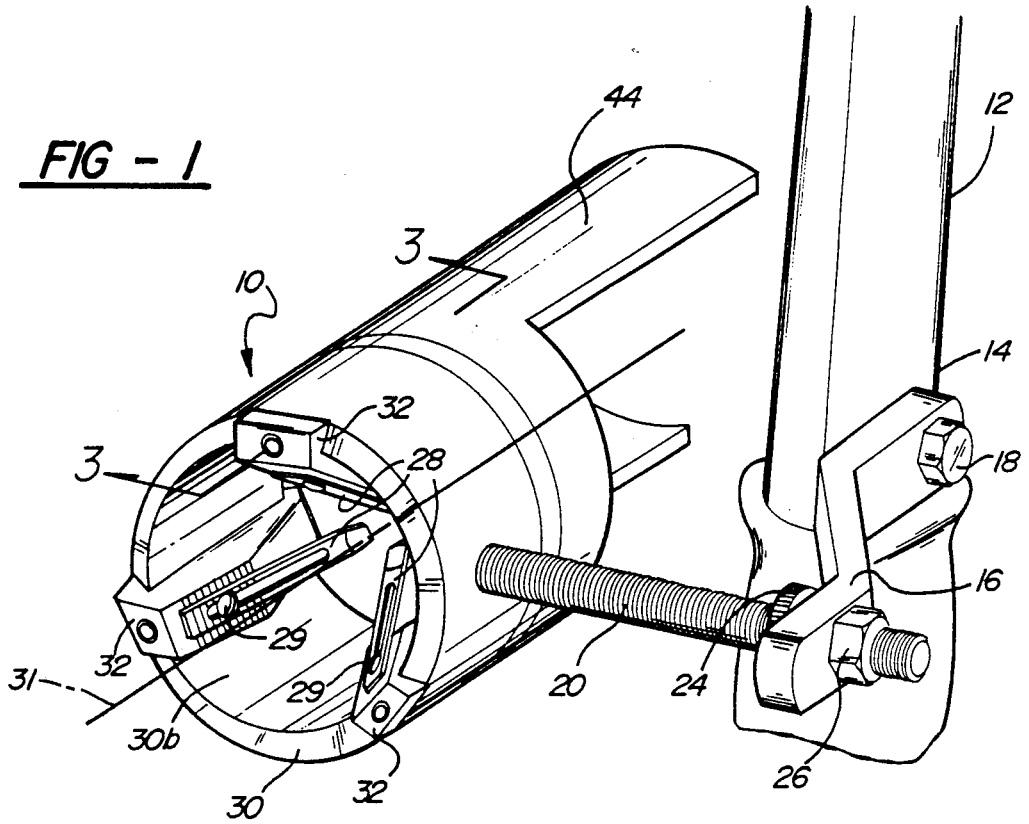
FIG - 3
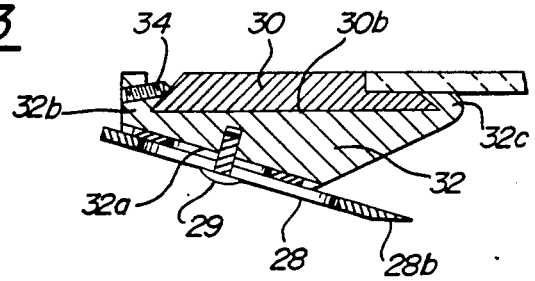
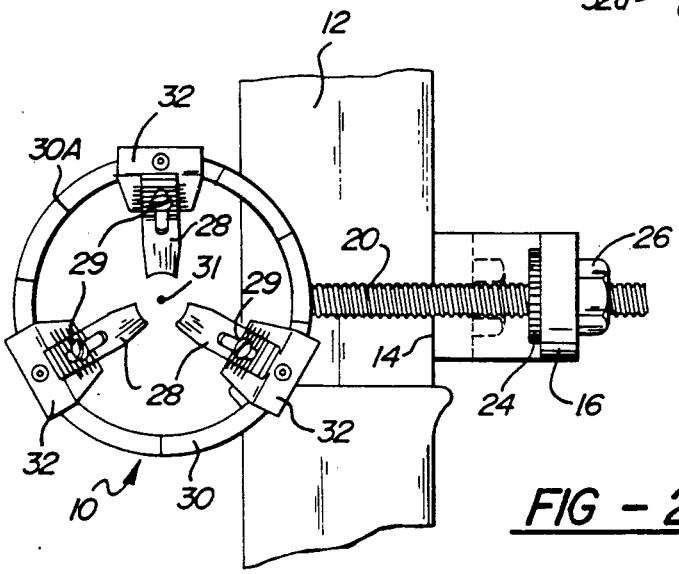
FIG - 2

ARROW SUPPORT FOR AN ARCHERY BOW

FIELD OF THE INVENTION

This invention generally relates to an apparatus used to guide and support an arrow released from an archery bow. The invention provides a safe and easily adjustable arrow support which allows for an efficient transfer of energy from the bow to the arrow.

BACKGROUND

A variety of arrow rests exist for supporting an arrow on an archery bow. See U.S. Pat. Nos. 4,372,282, 4,421,092, 4,759,337 and 4,351,311. Typically an arrow rest performs several functions, including: supporting an arrow prior to and during the drawing of the bow and guiding the arrow towards the intended target after the bowstring has been released. Additionally, an arrow rest should be able to compensate for any degree of arrow distortion occurring during the release of an arrow. The arrow rest should offer minimal resistance to enable the maximum energy to be transferred from the bow to the arrow.

Arrow distortion is the degree that the arrow bends or flexes from its true shape or rest position when absorbing energy. Distortion is applied at the instant of bow string release and is generally constant provided the applied energy is constant. Distortion may be vertical, lateral or a combination thereof.

Distortion may occur in two separate ways: inherent distortion, which results from inconsistencies in bow and arrow manufacture or method or bowstring release; and applied distortion, which results from intentionally mounting the arrow rest adjacent to rather than directly on the bow's optimum line of force or by mounting the bow string knock point above or below the optimum line of force. Previously, applied distortion was used to provide clearance of the arrow past the arrow rest. However, distortion of any type is undesirable as it results in a loss of energy transferred to the arrow upon release of the bow string.

The present invention, as disclosed herein, shows a device capable of utilizing an archery bow's direct line of force thereby resulting in an efficient transfer of energy to the arrow without a loss due to applied distortion as previously required in order for the arrow to clear the arrow rest. The invention also discloses the means to correct any inherent distortion resulting from equipment manufacture or abilities of the archer.

SUMMARY OF THE INVENTION

The present invention is directed toward providing an apparatus for providing support for an arrow adjacent the midpoint of an archery bow including a frame mounted to the bow. An annular member is mounted to the frame having a center line corresponding to the longitudinal axis of the arrow. A finger shoe is adjustably secured to the annular member for angular movement with respect to said center line. The finger shoe has a radially inner mounting surface skewed with respect to the center line of the annular member. A resilient finger is secured to the inner mounting surface of the finger shoe. In the preferred form, the finger has a tapered supporting end whereby the resiliency of the finger increases in magnitude from the supporting end to the mounting end.

A further object of the invention includes a finger spring secured between the finger and the finger shoe whereby the finger spring is adjustable so as to increase or decrease the resiliency of the finger. Additionally, the finger includes a concave area located on the supporting end of the finger for guiding said arrow through the annular member.

A second embodiment of the invention includes a guard means, secured to the annular member, for preventing an arrow from contacting the arm of the archer when the arrow is released from the bow. The guard means includes tubular structure extending from the annular member to the handle portion of the bow which prevents a misdirected arrow from striking the archer.

A further understanding of the invention and further objects, features and advantages thereof will be found subsequently apparent in the following description taken in conjunction with the accompany drawings.

BRIEF DESCRIPTION OF THE DRAWINGS

FIG. 1 is a perspective view of an archery bow utilizing a first embodiment of the present invention;

FIG. 2 is a rear view of the first embodiment of the present invention;

FIG. 3 is a side view of the first embodiment of the present invention;

DETAILED DESCRIPTION OF THE ILLUSTRATED EMBODIMENT

Figure 4:
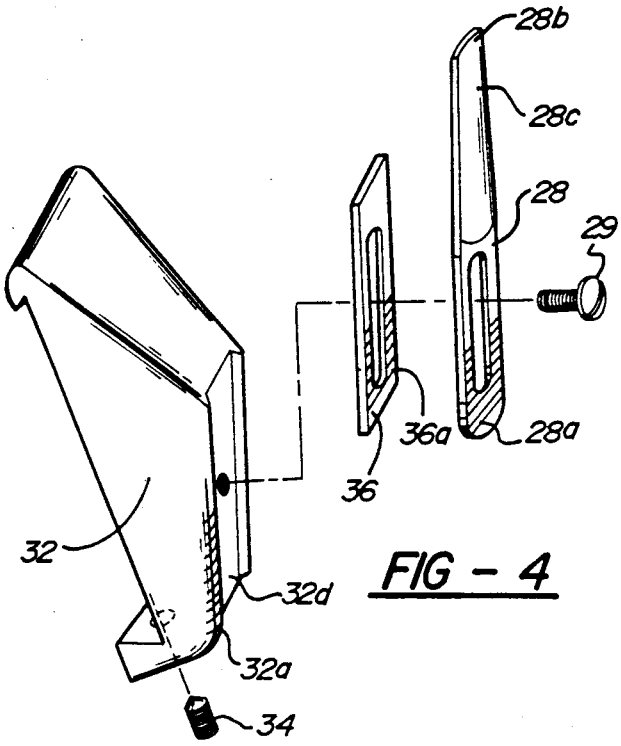
FIG. 4 is an exploded view of the finger assembly of the first embodiment of the present invention.

Referring now to FIGS. 1 and 2, the arrow support 10 of the present invention is shown attached to the midpoint 14 of an archery bow 12. A frame member 16 is mounted to the archery bow by means of a threaded fastener 18 received by an insert (not shown) provided on most modern archery bows. The insert, common to modern bows and described by the Archery Manufacturing Organization (AMO) standards, is provided on the bow riser at the manufacturer's recommended location, and is intended for mounting accessories to the bow.

The arrow support 10 is comprised of an annular body 30 secured to the frame 16 by means of a threaded rod 20 threadably engaged in the annular body 30. The threaded rod is adjustably mounted in the frame 16 by means of a thumb wheel 24 and locking nut 26. This arrangement allows the arrow support 10 to be laterally adjusted by rotating the thumb wheel 24 to place the support in the desired position and tightening the lock nut 26.

The annular body 30 is of sufficient diameter to provide unrestricted clearance of the archery arrow fletching, and by totally encompassing the arrow, limits the area endangered by a misdirected arrow, therefore adding a margin of safety. Finger shoes 32 are slidably secured within the annular body 30. Support fingers 28 are adjustably secured to the shoes 32 and provide support and guidance for the arrow.

Referring now to FIG. 3, the front portion 32*c* of the finger shoe 32 hooks over the annular body 30 while the rear portion 32*b* of finger shoe 32 is positioned at the desired point. A lock screw 34 provides the clamping means to retain the finger shoe tight against the interior wall 30*b* of the annular body 30. Gradient marks 30*a* (FIG. 2) are provided on the annular body 30 to provide for precise circumferential adjustments. As shown in FIG. 3, the finger shoe 32 has an inner mounting surface 32*d*, skewed with respect to the center line 31 of the annular member 30, upon which the finger 28 is mounted. The inner mounting surface mounts the finger at approximately a 30° angle with respect to the center line 31 of the annular member 30.

The arrow support fingers 28 provide a means to position the arrow within the annular body 30. The support fingers 28 are adjustably mounted to the finger shoe 32 using a mounting screw 29 inserted through an internal slot 28*a* in the support finger 28 and threadably received in the finger shoe 32.

Figure 5A:
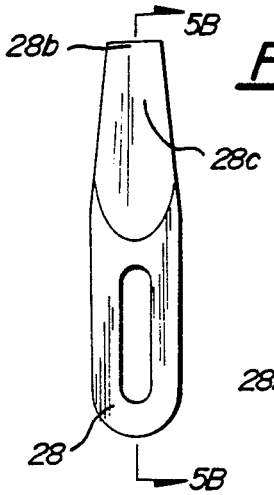
FIGS. 5*a* and 5*b* are a front view and side view of the finger member of the present invention.
Figure 5B:
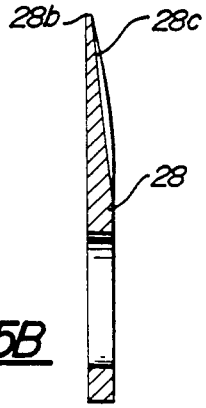

Referring to FIG. 5, the finger 28 is fabricated from a flexible material having a suitable resiliency. The finger 28 is tapered at the supporting end 28*b*, thereby increasing the resiliency at the supporting end 28*b*. A concave grooved portion 28*c* at the supporting end 28*b* is used to support and guide the arrow. The typical dimensions of the finger support are: an overall length of 1⅜ inches, a width of ⅜ inch at the mounting end tapered down to approximately 3/16 inch at the arrow supporting end and a thickness of approximately 080/1000 inch at the mounting end tapered down to 30/1000 at the supporting end. These dimensions result in a flexible arrow support 28, increasing in stiffness from the supporting end 28*b* to the mounting end.

FIG. 4 shows the manner the finger 28 is mounted to the finger block 32 using a mounting screw 29. An adjustable finger spring 36 may be used in conjunction with the finger shoe 32 and finger 28 for increasing or decreasing the resiliency of the finger 28. The finger shoe 32, finger spring 36 and finger 28 may be provided with gradient marks 32*a*, 36*a*, 28*a* in order to accurately position each finger 28 with respect to the arrow.

The flexibility and resiliency of the finger combined with the angle the finger is mounted at, provides an arrow support which offers minimal resistance to arrow passage, yet offers gradual but consistent response to arrow distortion.

Figure 6A:
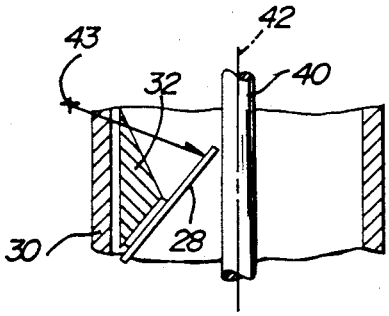
FIGS. 6*a* through 6*d* are fragmentary views showing finger response to arrow distortion.
Figure 6B:
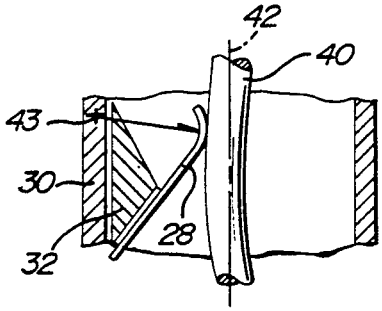

Arrow distortion may occur in any direction or degree of magnitude, in response to either applied or inherent distortion. The fingers 28 provide a consistent response based upon the degree of actual distortion. Arrow distortion correction is illustrated in FIGS. 6*a*–6*d*. FIG. 6*a* shows a non-distorted arrow 40 propelled along the optimum line of force 42. If no distortion occurs, the finger 28 fails to contact the arrow 40 thus resulting in no arrow correction, and therefore no resistance. Should the arrow 40 distort a slight amount, as shown in FIG. 6*b*, causing a slight deviation from the optimum line of force 42 the finger 28 gradually contacts the arrow and acts upon the arrow to urge it back to the direct line of force 42.

Figure 6C:
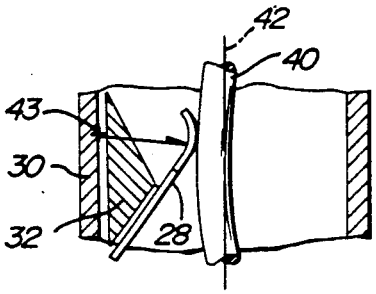
Figure 6D:
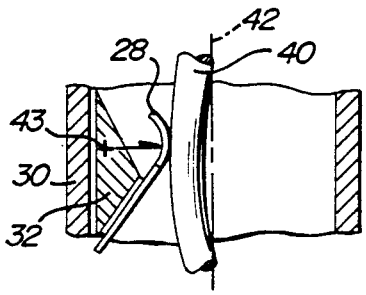

Referring to FIGS. 6*c* and 6*d* continued distortion increases the deviation of the arrow 40 from the optimum line of force 42. The increased deviation of the arrow 40 towards the annular body 30 shortens the arrow 40 to finger shoe 32 distance, thereby increasing the stiffness and corresponding resistance to arrow deviation the finger 28 by shortening the flex radius or hinge point 43. The further the arrow distorts and correspondingly deviates from the optimum line of force 42, the greater the resultant force applied by the finger 28 to urge the arrow back to the non-distorted position. The use of three resilient flexible supports provide the means necessary to independently react and compensate for any direction or magnitude of arrow distortion.

Figure 7:
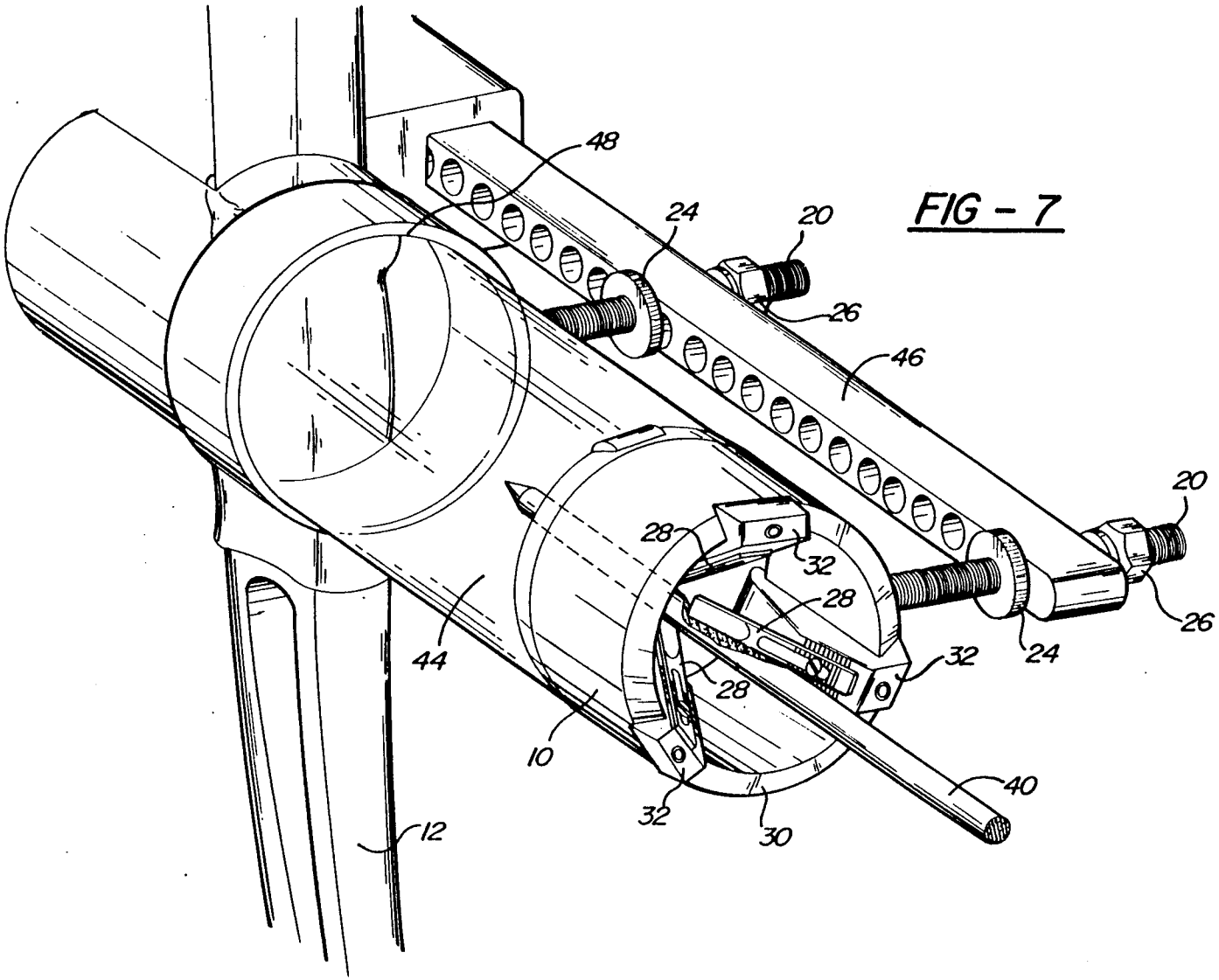
FIG. 7 is a perspective view of an archery bow utilizing the second embodiment of the present invention.

A second embodiment of the invention is shown in FIG. 7, where the arrow support may be used for supporting a shorter arrow 40 in position. Presently, archers are shooting shorter and lighter arrow from a standard archery bow. Shooting a shorter arrow requires drawing the arrow past or behind the midpoint of the bow, a practice commonly referred to as an overdraw. One problem with an overdraw is that the forearm of the archer when the bow is pulled is now located in front of the arrow point. A misdirected arrow may then strike the archer's forearm. Applicant's device provides a rigid guard tube 44 mounted adjacent to the arrow support 10. An adjustable frame member 46 is mounted to the bow midpoint utilizing the previously described threaded insert. The adjustable frame member 46 allows the guard tube 44 to be secured to the bow, by an additional mounting bracket 48, thereby protecting the archer's forearm. The guard tube 44 may be made from clear plastic or other suitable material and can be cut out or modified to extend past the midpoint and handle of the archery bow 12 thus protecting the archer's forearm and hand.

Although preferred embodiments of the invention have been illustrated and described in detail, it will be apparent that various changes may be made in the disclosed embodiment without departing from the scope or spirit of the invention. Moreover, the terms vertical, horizontal, upward and downward are used herein in a relative sense and do not suggest any given orientation of the mechanism described when placed in actual use.

I claim:

1. An apparatus providing support for an arrow adjacent the midpoint of an archery bow comprising:

a frame mounted to the bow;

an annular member mounted to the frame and having a center line;

a finger shoe adjustably secured to the annular member for angular movement about said center line, wherein the finger shoe may be circumferentially spaced on the annular member, said finger shoe having a radially inner mounting surface skewed with respect to the center line of the annular member; and a resilient finger adjustably secured to the inner mounting surface of the finger shoe, said finger having a mounting end secured to the finger shoe, and a supporting end supporting the arrow, whereby the resiliency of the said finger decreases in magnitude from the supporting end to the mounting end.

2. An apparatus according to claim 1 including an adjustable finger spring secured between the finger shoe and the finger whereby the finger spring may be adjusted to increase or decrease the resiliency of said finger.

3. An apparatus according to claim 1 wherein said finger includes a concave area on the supporting end for guiding said arrow.

4. An apparatus providing support for an arrow adjacent the midpoint of an archery bow comprising:

a frame mounted to the bow;

an annular member mounted to the frame having a center line;

a finger shoe adjustably secured to the annular member for angular movement about said center line, wherein the finger shoe may be circumferentially spaced on the annular member, said finger shoe having a radially inner mounting surface skewed with respect to the center line of the annular member;

a resilient finger adjustably secured to the inner mounting surface of the finger shoe, said finger having a mounting end secured to the finger shoe, and a supporting end supporting the arrow, whereby the resiliency of the said finger decreases in magnitude from the supporting end to the mounting end; and guard means mounted adjacent to said annular member extending from the annular member to the archery bow for preventing the arrow from contacting the arm of the archer when the arrow is released from the bow.

5. An apparatus according to claim 4 wherein said guard means comprises a tubular member attached to said annular member and extending outward from said annular member to the midpoint of said bow.

6. An apparatus according to claim 4 including an adjustable finger spring secured between the finger shoe and the finger whereby the finger spring may be adjusted to increase or decrease the resiliency of said finger.

7. An apparatus according to claim. 4 wherein said finger includes a concave area on the supporting end for guiding said arrow.

8. An apparatus providing guidance and support for an arrow adjacent the midpoint of an archery bow having an optimum line of force for maximum energy transfer from the bow to the arrow comprising:

a frame mounted to the bow;

an annular member mounted to the frame having a center line corresponding to the optimum line of force of the archery bow;

a finger shoe adjustably secured to the annular member for angular movement about said center line, wherein the finger shoe may be circumferentially spaced on the annular member, said finger shoe having a radially inner mounting surface skewed with respect to the center line of the annular member;

a resilient finger adjustably secured to the inner mounting surface of the finger shoe, said finger having a mounting end, secured to the finger shoe, and a supporting end, supporting the arrow, said finger being tapered at the supporting end, said finger further having a concave guide groove on said supporting end adjacent said center line for guiding and supporting said arrow; and an adjustable finger spring secured between the finger shoe and the finger, whereby the finger spring may be adjusted to increase or decrease the resiliency of the finger.

9. An apparatus providing support for an arrow adjacent the midpoint of an archery bow comprising:

a frame mounted to the bow;

an annular member mounted to the frame and having a center line corresponding to an optimum line of force of the archery box;

a finger shoe secured to the annular member, said finger shoe having a radially inner mounting surface skewed with respect to the center line of the annular member; and a resilient finger, secured to the inner mounting surface of the finger shoe, for supporting the arrow.

10. An apparatus according to claim 9 including a means for varying the resiliency of the finger whereby the resistance of the finger to deviation of the arrow from the center line increases in proportion to the degree of deviation.

11. An apparatus according to claim 10 wherein the means for varying the resiliency of the finger comprises an adjustable finger spring secured between the finger shoe and the finger, whereby the finger spring may be adjusted to increase or decrease the resiliency of the finger.

12. An apparatus according to claim 10 wherein the means for varying the resiliency of the finger comprises the finger being formed of a tapered configuration, whereby the degree of taper may be adjusted to increase or decrease the resiliency of the finger.

* * * * *

UNITED STATES PATENT AND TRADEMARK OFFICE

CERTIFICATE OF CORRECTION

PATENT NO. : 5,042,450

DATED : August 27, 1991

INVENTOR(S) : William J. Jacobson

It is certified that error appears in the above-identified patent and that said Letters Patent is hereby corrected as shown below:

Title page, ABSTRACT, line 5, delete "decreases" and insert -- increases --.

Column 1, Line 65, Please delete "increases" and insert -- decreases --.

Column 5, Line 28, Please delete "claim .4" and insert -- claim 4 --.

Signed and Sealed this

Fifth Day of January, 1993

*Attest:*

DOUGLAS B. COMER

*Attesting Officer*

*Acting Commissioner of Patents and Trademarks*